United States Patent [19]

Calam et al.

[11] Patent Number: 5,016,406

[45] Date of Patent: May 21, 1991

[54] INTERLOCKING ROOFCURB JOINT

[75] Inventors: Bruce T. Calam, Surrey; Rudy Karlowee, Burnaby, both of Canada

[73] Assignees: TNS Holdings Ltd.; RHC Investments Ltd., both of Richmond, Canada

[21] Appl. No.: 479,770

[22] Filed: Feb. 14, 1990

[51] Int. Cl.[5] ..... E04D 1/36

[52] U.S. Cl. ..... 52/58; 52/200

[58] Field of Search ..... 52/58, 600, 200, 219, 52/656; 403/403, 382, 205

[56] References Cited

U.S. PATENT DOCUMENTS

| | | | |
|---|---|---|---|
| 2,189,159 | 2/1940 | Anschicks | 52/282 X |
| 3,721,106 | 3/1973 | Bierwirth et al. . | |
| 3,749,908 | 7/1973 | Esser et al. | 52/200 X |
| 4,428,166 | 1/1984 | Burghart | 52/200 X |
| 4,501,193 | 2/1985 | Trigourea . | |
| 4,635,409 | 1/1987 | Vandemore | 52/219 X |

*Primary Examiner*—David A. Scherbel
*Assistant Examiner*—Creighton H. Smith
*Attorney, Agent, or Firm*—Christie, Parker & Hale

[57] ABSTRACT

This invention relates to a novel roof curb which can be constructed from modular components by interlocking joints. An interlocking joint for a roof curb which comprises a male joint member secured to the inner face of a first curb section, and a female joint member secured to the inner face of a second curb section, the male joint member and female joint member being adapted to mate with one another and arrange the first curb section and the second curb section at right angles with one another.

6 Claims, 3 Drawing Sheets

INTERLOCKING ROOFCURB JOINT

FIELD OF THE INVENTION

This invention relates to a novel roof curb which can be constructed from modular components by interlocking joints.

BACKGROUND OF THE INVENTION

Roof curbs are widely used in the air conditioning industry as foundation supports for air conditioning units mounted on the tops of roofs of buildings. The curbs are typically "roofed" into the roof by roofing material. The roof curbs are normally constructed either as a single unit comprised of welded together sides and end sections, or as components which are bolted together on the roof, before roofing in the curb and then placing the air conditioning unit on the assembled roof curb.

The difficulty with a roof curb that has been welded together at the factory and transported to the roof site is that the roof curb, which can typically vary anywhere from three to eight feet in width, and four to twenty-five feet in length, must be shipped as a unit thereby incurring high shipping costs. Also, heavy equipment must be used to raise the welded roof curb into location on the top of the roof. The advantage of the unitary construction is that it is square and always thus fits the air conditioning unit. Once the curb is roofed into place with roofing materials, the air conditioning unit can be moved into place on the roof curb.

A difficulty with roof curbs which are constructed of components which are bolted together is that a tradesman is required to bolt the components of the roof curb together on the roof of the building. This process typically takes at least an hour. Bolted curbs are not always practical because often inclement weather prevents the tradesman from bolting the roof curb components together in a timely fashion. Also, curbs which are bolted together may not always be square. If the non-square bolted curb is "roofed in", and the air conditioning unit is found to not fit the curb, then the roofing must be removed, the curb squared up, and then reroofed. This is expensive and time consuming.

The advantage of bolted roof curbs is that they can be hauled or lifted to the roof site as separate components, and the components bolted together in place on the roof. The roof curb components can be shipped in disassembled form, which greatly reduces freight costs. There is no need to use heavy hauling and lifting equipment.

U S. Pat. No. 4,501,193, Snyder, Feb. 26, 1985, discloses a mounting curb for rooftop packaged air conditioning units comprising a generally rectangular frame having a bottom wall with adjacent return and supply air duct openings formed therein and in communication with respective common supply and return air ducts formed in the curb. The return air duct includes opposed branch portions leading to openings in the top wall of the curb in communication with the return air openings in the air conditioning units. The supply air duct includes opposed branch portions also in communication with respective supply air openings in the bottom wall of the air conditioning unit enclosures. The supply air duct is disposed generally over the return air duct and inward therefrom with respect to the opposite end walls of the curb.

U.S. Pat. No. 3,721,106, Bierwirth et al., Mar. 20, 1973, discloses a rectilinear upstanding, continuous, rigid curb on a flat rooftop which defines an opening through the roof. Vibration isolation means are supported on the top of the periphery of this curb and, in turn, support the main frame of a complete air conditioning unit. The vibration isolation means includes a continuous sheet of flexible material in sealing relationship to both the entire lower outer periphery of the air conditioning unit frame and the entire upper outer periphery of the curb, and loosely disposed between the curb and frame. This sheet isolates the inside of the air conditioning unit and building from the outside thereof, and insulates the space within the curb and the unit from the temperature and weather conditions outside.

SUMMARY OF THE INVENTION

The invention pertains to a modular roof curb for supporting an air conditioning unit on a roof. The roof curb is constructed of modular units which can be hauled and lifted to the roof site, and by means of a unique interlocking joint at each corner, can be quickly assembled on the roof site without the requirement of skilled labor. Assembly can be done in a matter of several minutes. Once assembled, the roof curb is ready for mounting an air conditioning unit. The curb is self-squaring.

The invention pertains to an interlocking joint for a roof curb which comprises a male joint member secured to the inner face of a first curb section, and a female joint member secured to the inner face of a second curb section, the male joint member and female joint member being adapted to mate with one another and arrange the first curb section and the second curb section at right angles with one another.

The invention is directed to an interlocking joint for a roof curb which comprises: (a) a male joint member secured to the inner face of the end of a roof curb side section; and (b) a female joint member secured to the inner face of the end of a roof curb end section, the female joint member being constructed so that it has an inner face and an outer face, which together form between them a receptacle which is adapted to receive the male joint member (a).

The male joint member can be constructed to have an "L" shape, the stem of the "L" being jogged so that the upper portion of the jogged stem adheres to the inner surface of the side section, the lower portion of the jogged stem defines a space with the inner surface of the side section, and the foot of the "L" extends inwardly from the inner face of the side section.

The outer face of the of the female joint member can be a leg and be constructed to have an "L" shape. The inner face of the female joint member can be a leg which has a jogged shape, one portion of the jogged shape abutting the stem of the "L" shaped outer leg, while the other part of the jogged shape defines a space between the inner leg and the outer leg, the space being adapted to receive the foot of the "L" shaped male member.

The side section face and the lower portion of the jogged stem of the "L" shaped male joint member can define a space which is adapted to receive the foot of the "L" shaped outer leg of the female joint member.

The female joint and the male joint components can be secured respectively to the inner faces of the side section and end section respectively by spot welds.

At least a part of the male joint member and a part of the female joint member can extend inwardly at right angles to the respective inner faces and can be adapted to arrange the respective side sections and end sections together at right angles.

DRAWINGS

In drawings which illustrate a specific embodiment of the invention, but which should not be construed as restricting the spirit or scope of the invention in any way:

DETAILED DESCRIPTION OF A SPECIFIC EMBODIMENT OF THE INVENTION

Figure 1:
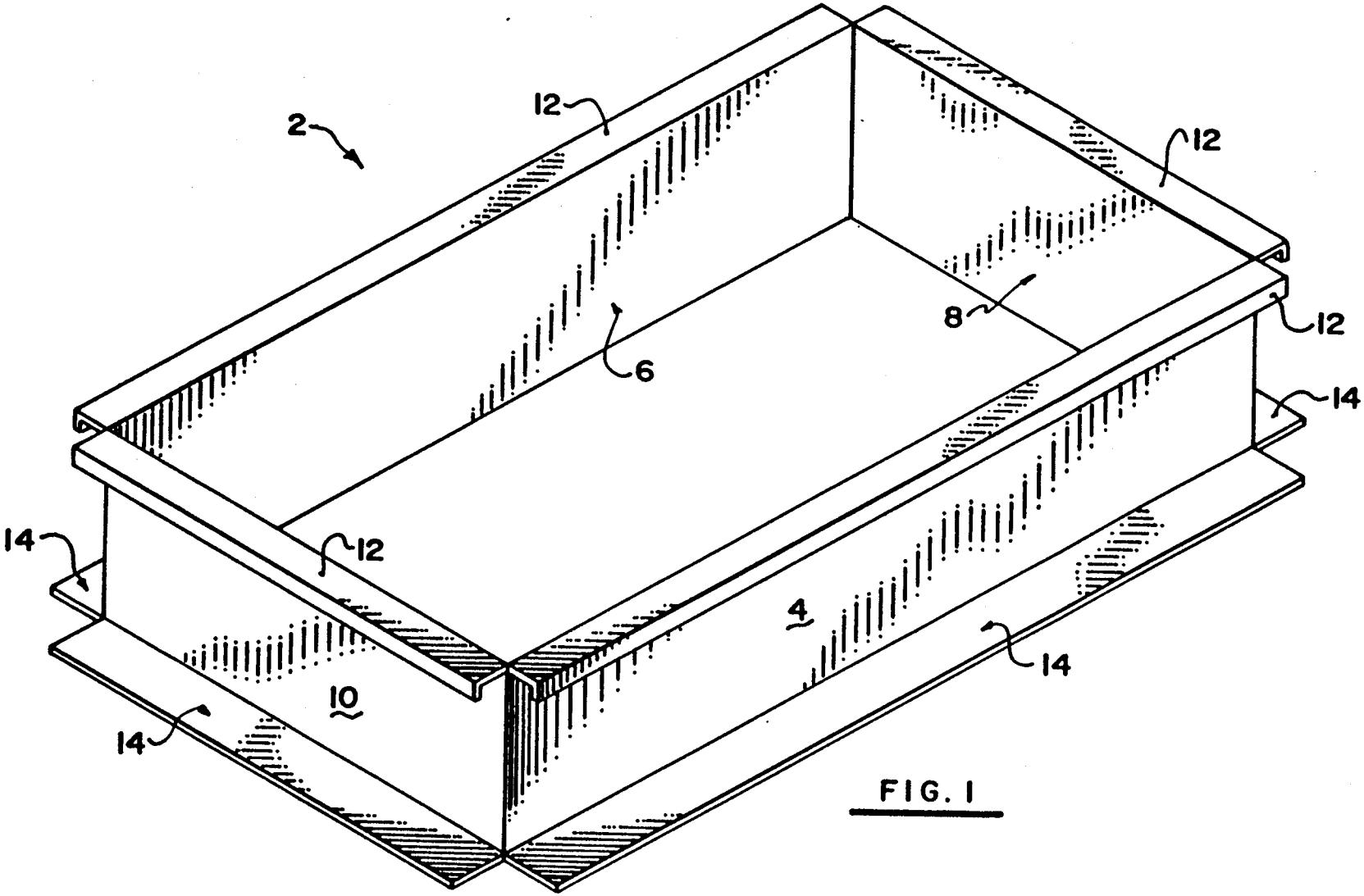
FIG. 1 illustrates an isometric view of an assembled roof curb used for supporting an air conditioner.

Referring to FIG. 1, which illustrates an isometric view of an assembled roof curb 2, it can be seen that the assembled roof curb 2 is constructed of a pair of opposing parallel side sections 4 and 6, and a pair of opposing parallel end sections 8 and 10, which are joined with the side sections 4 and 6 to form a rectangular unit. The side sections 4 and 6 and the end sections 8 and 10 have respective top flanges 12 and bottom flanges 14, which extend horizontally and to the exterior of the respective side and end sections. FIG. 1 is intended simply to provide a general overall layout for purposes of illustrating the invention, and does not per se show the unique interlocking joint of the invention.

Figure 2:
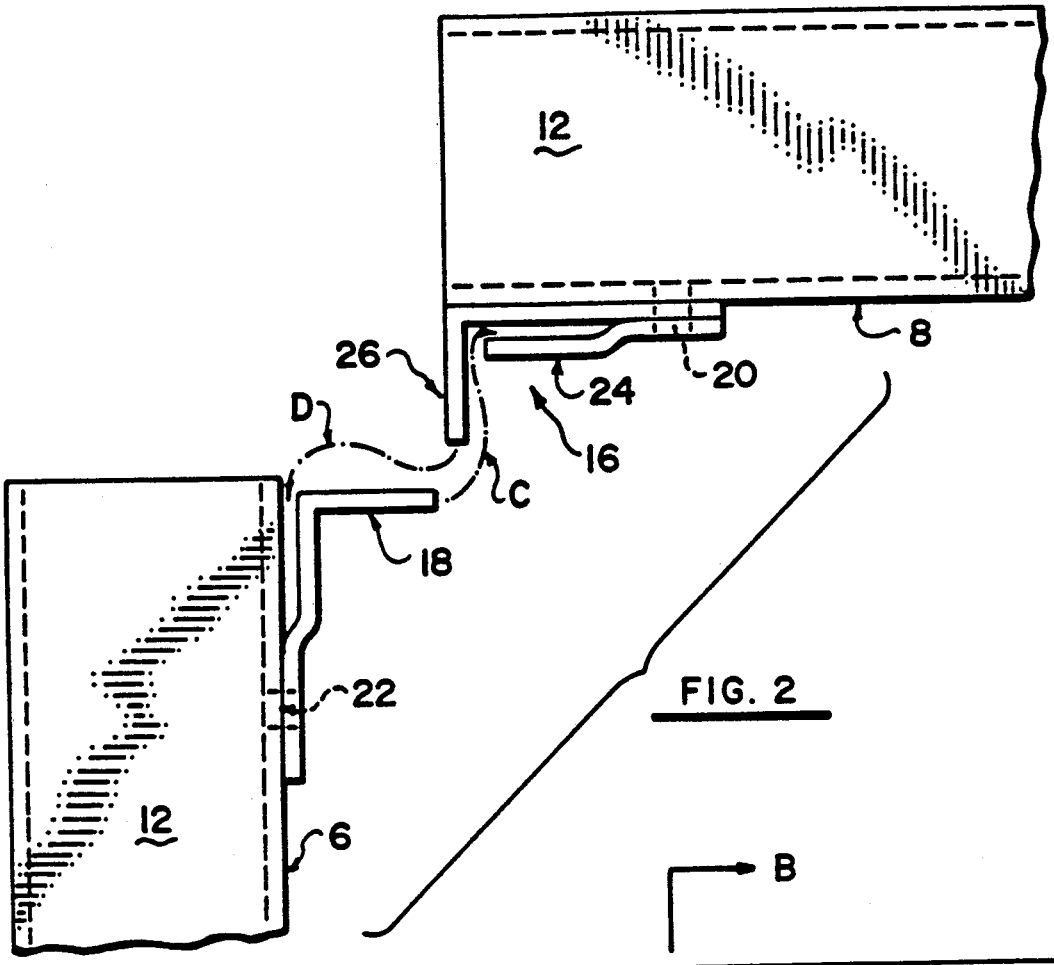
FIG. 2 illustrates a plan view of a part of a side section and a part of an end section of a roof curb, with the corner joints disassembled.

Referring to FIG. 2, which illustrates a plan view of part of a side section 6, and an end section 8, in disassembled form, it can be seen that the unique interlocking joint of the invention is constructed of a female joint member 16, and a male joint member 18, which are designed to mate and interlock with one another. The dashed arrow C shows where the male member 18 fits. The female joint member 16, secured to the inner face of end section 8, is constructed of two components, namely, an inner leg 24 and an outer leg 26. Dashed arrow D shows where the outer leg 26 fits. The female joint member 16 is fastened to the interior surface of the end section 8 by means of a spot weld 20. Likewise, male joint member 18 is fastened to the inner surface of side section 6 by means of spot weld 22. FIG. 2 also illustrates the respective top flanges 12 which extend outwardly from the respective side section 6 and the end section 8.

Figure 3:
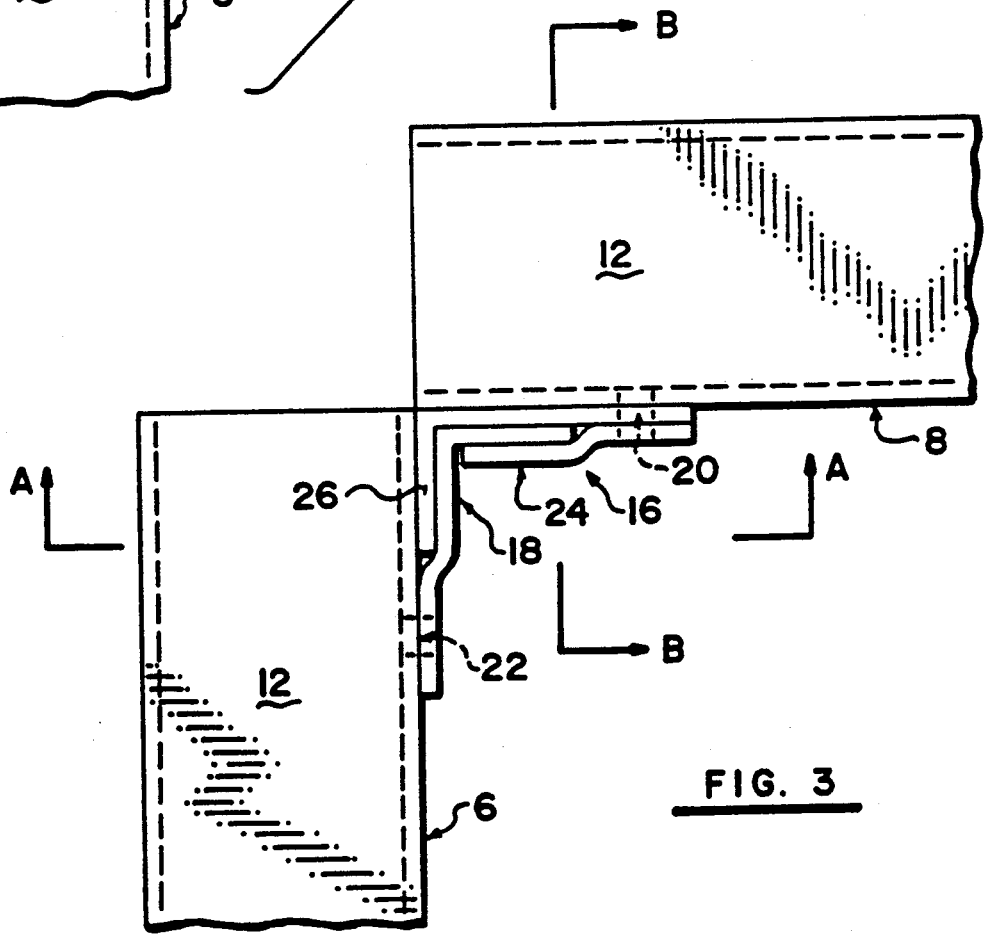
FIG. 3 illustrates a plan view of a side section and the end section of the roof curb assembled together by utilizing the interlocking joint.

FIG. 3 illustrates a plan view of a side section 6 and an end section 8 assembled together by means of female joint member 16 interlocking with male joint member 18. The female joint member 16 and the male joint member 18 are assembled together simply by sliding male joint member 18 either from the top or the bottom into the recess in female joint member 16 formed by inner leg 24 and outer leg 26. By means of the female joint member 16 and the male joint member 18 formed on the inner corners of the two side sections 4 and 6, and the two end sections 8 and 10, an entire roof curb 2, can be assembled together in a matter of minutes. This is considerably faster than is possible by having the side sections and end sections joined together by means of bolts.

Also, since male joint member 18 is at right angles to the inner face of end section 8, a "square" joint is always formed when male joint member 18 and female joint member 16 are interlocked.

The joint has a further advantage in that it is easy to construct, relatively inexpensive, and extremely reliable in forming a square curb. The advantage of the system is that the pair of side sections 4 and 6, and the pair of end sections 8 and 10, can be hauled to and lifted onto the roof site, in disassembled form, and then without the need of special assembly tools, readily assembled together by any unskilled workman.

Figure 4:
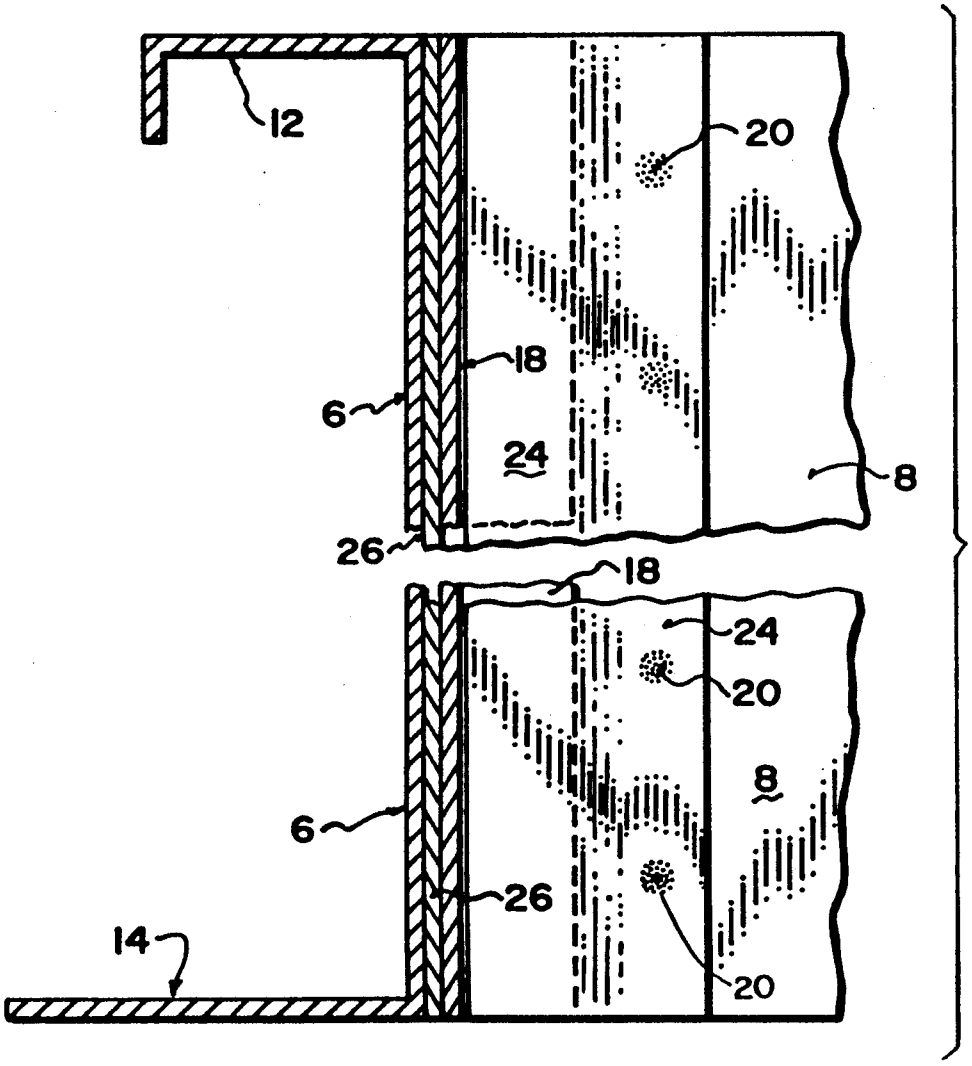
FIG. 4 illustrates a section view taken through section A—A of FIG. 3.

FIG. 4 illustrates a section view taken along section line A—A of FIG. 3. FIG. 4 illustrates the construction of the joint as seen from one side, rather than in plan view. Visible in FIG. 4 is side section 6, shown in end view, side section 6 having top flange 12 extending horizontally and externally thereof, and bottom flange 14 extending horizontally and externally thereof. Inner leg 24 of female joint 16 is visible in side view, while male joint member 18 is visible in end view. A series of spot welds 20 secure inner leg 24 to the inner face of end section 8.

Figure 5:
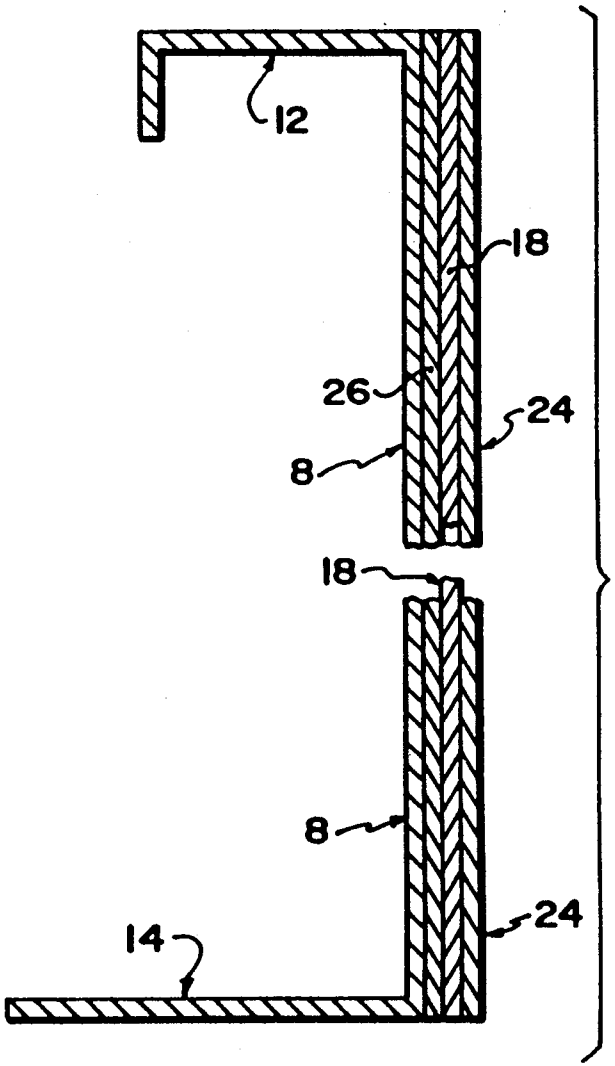
FIG. 5 illustrates a section view taken along section line B—B of FIG. 3.

FIG. 5 illustrates a section view taken along section line B—B of FIG. 3. Top flange 12, and bottom flange 14, extend externally from end section 8. Inner leg 24, and outer leg 26, shown in end view, enclose and hold male joint member 18.

While spot welds are shown in the drawings, and described above, it will be understood that the male and female joints 18 and 16 can be secured to the inner faces of side and end sections 6 and 8 by other suitable means, such as with a dimpler machine, or an automatic welder, or with screws or bolts.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

The embodiments of the invention in which an exclusive property or privilege is claimed are defined as follows:

1. An interlocking joint for a roof curb which comprises a male joint member secured to an inner face of a side section of a first curb section, the male joint member being constructed to have an "L" shape, the stem of the "L" being jogged so that an upper portion of the jogged stem adheres to the inner face of the side section, the lower portion of the jogged stem defining a space with the inner face of the side section, and the foot of the "L" extending inwardly from the inner face of the side section, and a female joint member secured to an inner face of an end section of a second curb section, the male joint member and female joint member being adapted to mate with one another and arrange the first curb section and the second curb section at right angles with one another.

2. A joint as claimed in claim 1 wherein an outer face of the female joint member comprises an outer leg which is constructed to have an "L" shape.

3. A joint as claimed in claim 2 wherein an inner face of the female joint member comprises an inner leg which has a jogged shape, one portion of the jogged shape abutting the stem of the "L" shaped outer leg, while the other portion of the jogged shape defines a space between the inner leg and the outer leg, the space being adapted to receive the foot of the "L" shaped male member.

4. A joint as claimed in claim 3 wherein the side section face and the lower portion of the jogged stem of the "L" shaped male joint member define a space which is adapted to receive the foot of the "L" shaped outer leg of the female joint member.

5. A joint as claimed in claim 1, 2 or 3 wherein the joint and the male joint components are secured respectively to the inner faces of the side section and end section respectively by spot welds.

6. A joint as claimed in claim 2, 3 or 4 wherein at least a part of the male joint member and a part of the female joint member extend inwardly at right angles to the respective inner faces and are adapted to arrange the respective side section and end section together at right angles.

* * * * *